US006691611B2

(12) United States Patent
Görbing et al.

(10) Patent No.: US 6,691,611 B2
(45) Date of Patent: Feb. 17, 2004

(54) METHOD AND APPARATUS FOR GUIDING AND TRANSFERRING A SHEET IN A PRINTING MACHINE

(75) Inventors: Christian Görbing, Heidelberg (DE); Karl-Heinz Helmstädter, Heidelberg (DE); Albert Maul, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/998,719

(22) Filed: Nov. 30, 2001

(65) Prior Publication Data

US 2002/0078843 A1 Jun. 27, 2002

(30) Foreign Application Priority Data

Nov. 30, 2000 (DE) ..... 100 59 863
Aug. 28, 2001 (DE) ..... 101 43 098

(51) Int. Cl.[7] ..... B41F 5/02; B41F 1/30

(52) U.S. Cl. ..... 101/230; 101/231; 101/232; 101/246; 101/409

(58) Field of Search ..... 101/183, 222, 101/223, 230, 231, 232, 246, 408, 409, 179, 180; 271/275, 276, 277

(56) References Cited

U.S. PATENT DOCUMENTS 3,167,006 A 1/1965 Peyrebrune
3,525,304 A 8/1970 Norton et al.
4,419,003 A * 12/1983 Fujie et al. ..... 399/322
4,425,695 A * 1/1984 Tokuno ..... 492/4
4,443,094 A * 4/1984 Ricciardi ..... 101/411
4,598,641 A * 7/1986 Fischer ..... 101/246
5,622,113 A * 4/1997 Hansen ..... 101/483
6,089,155 A 7/2000 Kemmerer et al.
6,095,043 A * 8/2000 Hartmann et al. ..... 101/183
6,098,543 A 8/2000 Becker et al.

FOREIGN PATENT DOCUMENTS

DE 198 14 320 C1 4/1999
DE 198 22 206 A1 11/1999

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Ralph E. Locher

(57) ABSTRACT

An apparatus for guiding and transferring a sheet in a printing machine from a first cylinder to a gripper of a second cylinder in which the apparatus has a guide device for a holding element, which is held outside the first and second cylinder. In this way, the design of the guide apparatus can be independent of the first and second cylinders. In addition, a longer time period is available for gripping, tensioning and transferring the sheet. The apparatus can be used both in a recto printing machine and in a turner device in recto and verso printing.

24 Claims, 13 Drawing Sheets

METHOD AND APPARATUS FOR GUIDING AND TRANSFERRING A SHEET IN A PRINTING MACHINE

BACKGROUND OF THE INVENTION

Field of the Invention

The invention relates to a method and an apparatus for guiding and transferring a sheet in a printing machine from a first cylinder to a gripper of a second cylinder using a holding element that guides and transfers a sheet.

In sheet-fed printing machines, the sheets to be printed are held by a first cylinder and are subsequently transferred to a second cylinder. The second cylinder transports the sheet onward and transfers the sheet to a further cylinder. In this way, the sheets, to be printed, pass through the sheet-fed printing machine. In the recto printing operation, the sheet is in each case transferred by the leading edge. In the verso printing operation, the sheet is transferred by the trailing edge by a turner device in a turning operation. The transfer of the sheet should be carried out quickly and precisely and any damage to the sheet should be avoided.

Published German Patent Application DE 19822306 A1 discloses a sheet-fed printing machine that uses a suction gripper in order to transfer the sheet from the first cylinder to a gripper of the second cylinder. The suction gripper is fixed to the second cylinder and pivots against the trailing edge of the sheet, which is still held at the leading edge by a gripper belonging to the first cylinder. The suction gripper attracts the sheet by suction, tensions the sheet in the direction of the trailing edge and subsequently pivots it toward a second gripper, which is arranged on the second cylinder. The second gripper grips the sheet at the trailing edge and the suction gripper then releases the sheet. In a further step, the gripper of the first cylinder also releases the leading edge of the sheet, so that the sheet is transported onward by the second gripper and the second cylinder in the turned state. The suction gripper has to be configured on the second cylinder in a mechanically relatively complicated manner, and because of the required installation space for the suction gripper, the second cylinder cannot be designed as a non-contact transfer drum. The actions of transferring and tensioning the sheet by the suction gripper have to be carried out in a relatively short time, so that high printing speeds are problematic.

SUMMARY OF THE INVENTION

It is accordingly an object of the invention to provide an apparatus and a method for guiding and transferring a sheet from a first cylinder to an adjacent second cylinder which overcomes the above-mentioned disadvantages of the prior art apparatus and methods of this general type. In particular, it is an object of the invention to provide a better method and a better apparatus for guiding and transferring a sheet while maintaining register in a printing machine.

With the foregoing and other objects in view there is provided, in accordance with the invention, an apparatus for guiding and transferring a sheet in a sheet-processing machine from a first cylinder to an immediately adjacent second cylinder. The apparatus includes: a holding element that guides and transfers the sheet from the first cylinder to the immediately adjacent second cylinder; and a guide device for guiding the holding element. The guide device is held outside the first cylinder and outside the second cylinder, and is preferably parallel to the first and second cylinder or other sheet transport devices. In this way, it is not necessary to adapt the guide device to the overall space available on the first or second cylinder. This means that more flexible construction of the guide device and the cylinders is possible.

In accordance with an added feature of the invention, the guide device is preferably a belt which circulates in the form of an endless belt. The embodiment offers the advantage that the guide device is constructed simply and cost-effectively.

In accordance with an additional feature of the invention, guides for the holding element are located on both sides on the machine frame, together with appropriate flexible drive means, for example a toothed belt or a chain. The holding elements are formed by bridge-like parts.

In accordance with another feature of the invention, the guide device and the holding element are designed in such a way that they can be pivoted into and out of a recess in the second cylinder. In this way, transfer of the sheet can be carried out precisely in the range of the gripper, without the gripper of the second cylinder having to be moved too far out of the circumferential wall of the second cylinder.

In accordance with a further feature of the invention, in addition to an appropriate guide, the holding element can be pivoted into and out of the recess in the second cylinder by superimposing a second movement, which, for example, is controlled by a two-element or multi-element crank mechanism. As a result, it can be ensured that the holding element is braked and pivoted out quickly. This design is particularly suitable for implementing a turner device.

In accordance with a further added feature of the invention, a plurality of tapes with holding elements are provided, which are preferably arranged at different angles with respect to the direction of rotation of the first cylinder. In this way, smooth contact between the sheet and the circumferential wall of the first cylinder can be achieved.

In accordance with a further additional feature of the invention, preferably, at least two holding elements circulate. The two holding elements are each assigned to a trailing edge of two sheets following one another. This provides an efficient configuration of a belt with the holding elements. The belt is preferably driven by a motor at a running speed which corresponds to the rotational speed of the first cylinder. In a development of the invention, the running speed of the belt can be varied, so that the belt, for example in order to tension the sheet, is moved at a lower running speed than the rotational speed of the first cylinder. In this way, tensioning of the sheet on the circumferential surface of the first cylinder is made possible.

In accordance with yet an added feature of the invention, the holding elements are led through between the first and second cylinder and led back around the second cylinder.

In accordance with yet an additional feature of the invention, the holding element can have at least two movable elements, so that the holding element can follow a movement path differing from the guide path. The provided control means, such as control rollers/roller levers and control cams, initiate the appropriate movements. In this case, the advantage resides, in particular, in the fact that the holding element has a speed that differs from the drive means, for example, a chain or a toothed belt, so that a sheet that is held by the holding element can be tensioned.

In accordance with yet another feature of the invention, in order to eliminate the need for further movable elements, which would have to be controlled, the holding element is preferably constructed as a suction gripper.

The holding element preferably has a suction device, with which the sheets can be attracted by suction. As a result of using the suction device, gripping the sheet, and if appropriate, lifting it off the cylinder surface, and also tensioning the sheet, is possible.

The holding elements are preferably associated with the sheet trailing edge, but can also hold or guide the sheet leading edge or other regions of the sheet.

With the foregoing and other objects in view there is provided, in accordance with the invention, a method of transporting a sheet through a printing machine, that includes holding a leading edge of the sheet and holding a trailing edge of the sheet while transporting the sheet.

A plurality of holding and guiding devices can be used in the entire area of the printing machine parallel to the sheet-carrying cylinders and this permits a sheet to be transported in such a way that the latter is held both at its leading and at its trailing edge.

In accordance with a concomitant feature of the invention, during a tensioning operation, slippage between the holding element and the sheet is possible.

Other features which are considered as characteristic for the invention are set forth in the appended claims.

Although the invention is illustrated and described herein as embodied in method and apparatus for guiding and transferring a sheet in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
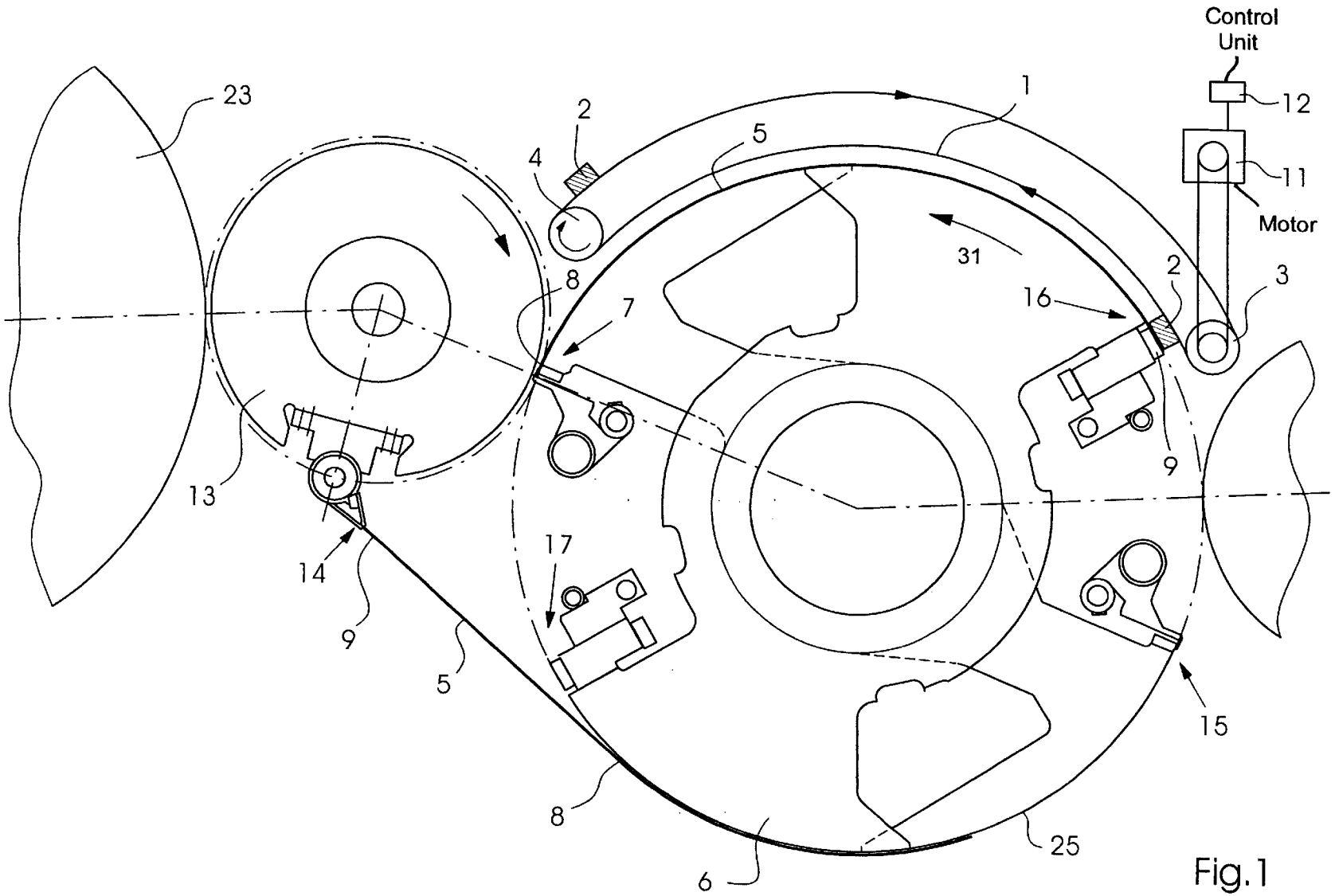
FIG. 1 schematically shows a partial cross section through a printing machine having an apparatus for guiding and transferring a sheet from a first cylinder to a second cylinder.

Referring now to the figures of the drawing in detail and first, particularly, to FIG. 1 thereof, there is shown a partial cross section of a printing machine having a first cylinder 6, a second cylinder 13 and a third cylinder 23. The first cylinder 6 constitutes a storage drum, for example. The second cylinder 13 constitutes a turner cylinder and the third cylinder 23 constitutes an impression cylinder. The first cylinder 6 has a first gripper 7, with which a sheet leading edge 8 of a sheet 5 is gripped and with which the sheet 5 is transported along the circumferential direction of the first cylinder 6. The first cylinder 6 rotates in the counterclockwise direction, the direction of rotation being indicated in the form of an arrow 31. Arranged above the first cylinder 6 is a belt 1 in the form of an endless belt, which circulates between two end points. A first end point is formed by a first shaft 3, and a second end point is formed by a second shaft 4. The first and second shafts 3, 4 are clamped into side frames of the printing machine and in each case are rotatably mounted via a central axle. The belt 1 is led between the first and the second shaft 3, 4 in predefined movement paths, preferably via a split guide comprising two guide plates in each case. The lower movement path is formed to accord with the curvature of the circumferential wall of the first cylinder 6. The lower movement path is preferably formed so that a holding element 2, which is fixed to the belt 1, rests on the circumferential wall 25 of the first cylinder 6 when the holding element 2 is being moved by the belt 1. In a simple embodiment, the holding element 2 is formed as a rubber block which has a holding surface that is associated with the circumferential wall 25. The holding surface is preferably formed from a material that has an increased coefficient of friction, so that when the holding element 2 rests on a sheet 5, the sheet 5 has a frictional connection with the holding element 2. Thus, for example, tensioning of the sheet 5 on the circumferential wall 25 is possible if the holding element 2 moves at a lower speed in the direction of rotation of the first cylinder 6 than that at which the first cylinder 6 rotates.

In a development of the invention, the holding element 2 is provided with a suction opening 22 (FIG. 6), which permits the sheet 5 to be sucked against the holding element 2. This permits the sheet 5 to be fixed to the holding element 2. In a preferred embodiment, the belt 1 has two holding elements 2, which are arranged in relation to the positions of the first gripper 7 and of a second gripper 15 belonging to the first cylinder 6. The two holding elements 2 are arranged in such a way that one holding element 2 makes contact in the area of a trailing edge 9 of a sheet 5 when the leading edge 8 of the sheet is held by the first or second gripper 7, 15. FIG. 1 illustrates a situation in which a holding element 2 is just coming into contact with the sheet trailing edge 9, and together with the sheet 5, is guided parallel to the direction of movement of the sheet 5. In this way, the sheet trailing edge is held down on the circumferential wall 25 and lifting of the sheet 5 is prevented.

The first shaft 3 is connected via a gear mechanism to a motor 11, which is controlled by a control unit 12. The motor 11 can preferably have its rotational speed variably adjusted by the control unit 12, so that the running speed of the belt 1 can also be adjusted. In a simple embodiment, the belt 1 runs at the same speed as the circumferential wall 25 rotates. In order to tauten the sheet 5 on the circumferential wall 25, after the holding element 2 has been set down in the area of the sheet trailing edge 9, the belt 1 is preferably moved at a somewhat slower speed than the rotational speed of the circumferential wall 25, so that the sheet 5 carries out a slight differential movement with respect to the holding element 2. Since the holding element 2 tensions the sheet 5 on the circumferential wall 25, the sheet 5 is tensioned on the circumferential wall 25 by the differential movement. In this way, exact positioning of the sheet trailing edge 9 is achieved.

In a simple embodiment, the belt 1 is braked by a simple mechanical means when it picks up or transfers a sheet 5. The means, for example, can briefly rest laterally on the belt 1. In addition, in the area in which the belt is to be braked, the guide rail of the belt can also have a smaller width. Also, the belt can be broadened in the area of the holding element, so that the belt is braked only in this area.

In a development of the invention, a first sucker 16 and a second sucker 17 are arranged on the first cylinder 6. Each sucker 16, 17 is arranged within the circumferential wall 25 in the area of a sheet trailing edge 9 of a sheet 5, so that the sheet trailing edge 9 of a sheet 5 is also held on the circumferential wall 25 by the first sucker 16 or the second sucker 17.

FIG. 1 shows the second cylinder 13, which moves counter to the direction of rotation of the first cylinder 6 and therefore executes a rotation in the clockwise direction. A tongs-type gripper 14 that is arranged on the second cylinder 13 has gripped the sheet trailing edge 9 of a sheet 5 while the sheet leading edge 8 of this sheet 5 is still resting on the circumferential wall 25 of the first cylinder 6. The sheet leading edge 8 is released by the second gripper 15 after the sheet trailing edge 9 has been gripped.

Figure 2:
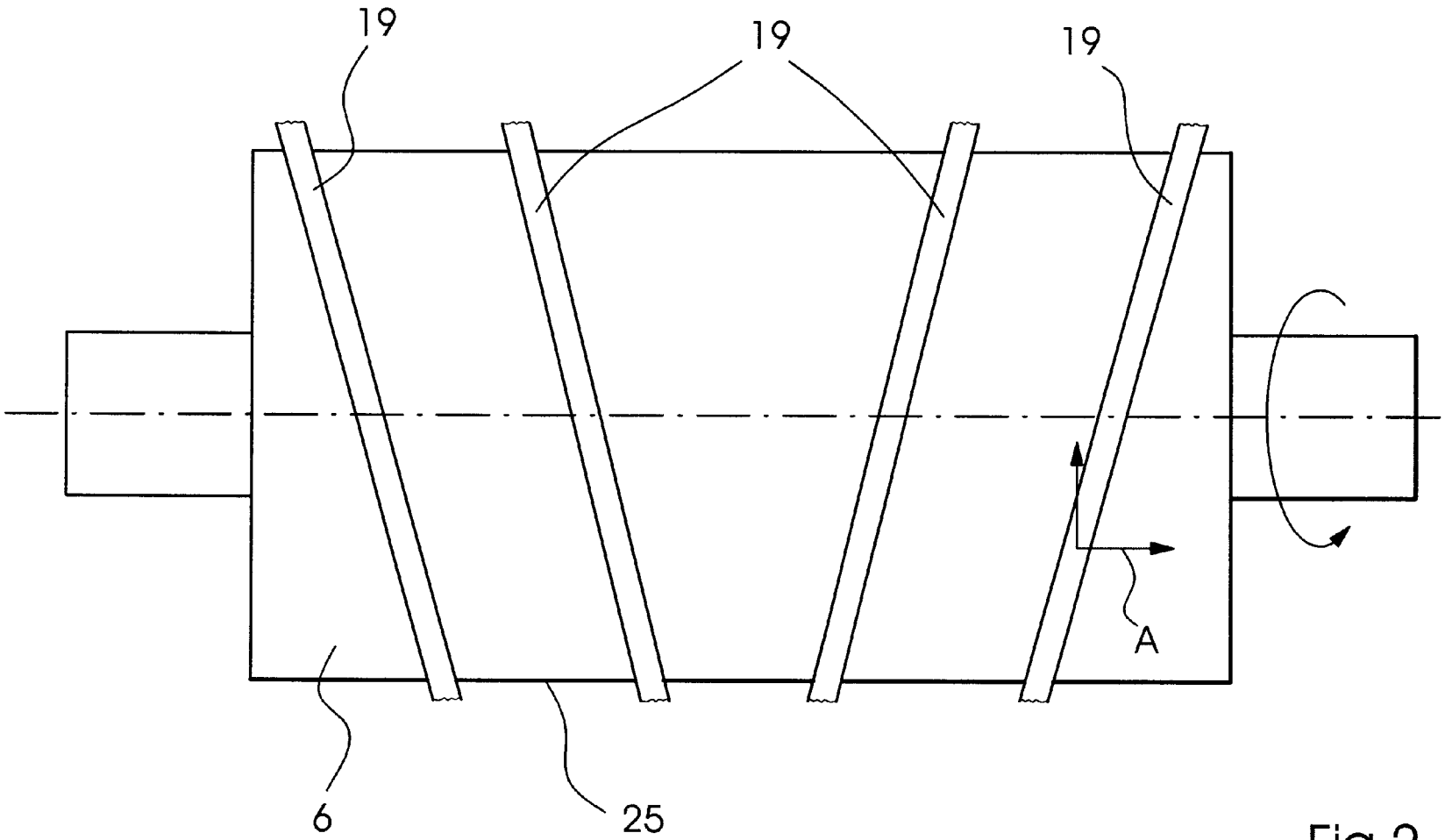
FIG. 2 shows a plan view of the first cylinder of the printing machine.

FIG. 2 shows a plan view of the first cylinder 6, over which a plurality of further belts 19 are arranged. The further belts 19 are constructed with a form and a function corresponding to the belt 1. However, the particular embodiment of FIG. 2 consists in the fact that the further belts 19 are not arranged parallel to the direction of rotation of the circumferential wall 25, but are aligned at a predefined angle to the direction of rotation. In this way, for example, lateral tensioning of the sheet 5 is achieved.

Using a plurality of further belts 19 offers the advantage that a sheet 5 can be tensioned over its width and its length. The direction of rotation of the first cylinder 6 is downward, and the further belts 19 are in each case aligned outward on a right-hand and left-hand half of the first cylinder 6. If the sheet 5 is moved more quickly than the further belts, then the further belts 19 have a movement component A at right angles to the longitudinal movement of the sheet 5, which leads to a tensioning of the sheet 5 in the lateral direction. However, the further belts 19 can also be arranged parallel to the direction of rotation of the circumferential wall 25, as in the case of the belt 1.

Figure 3:
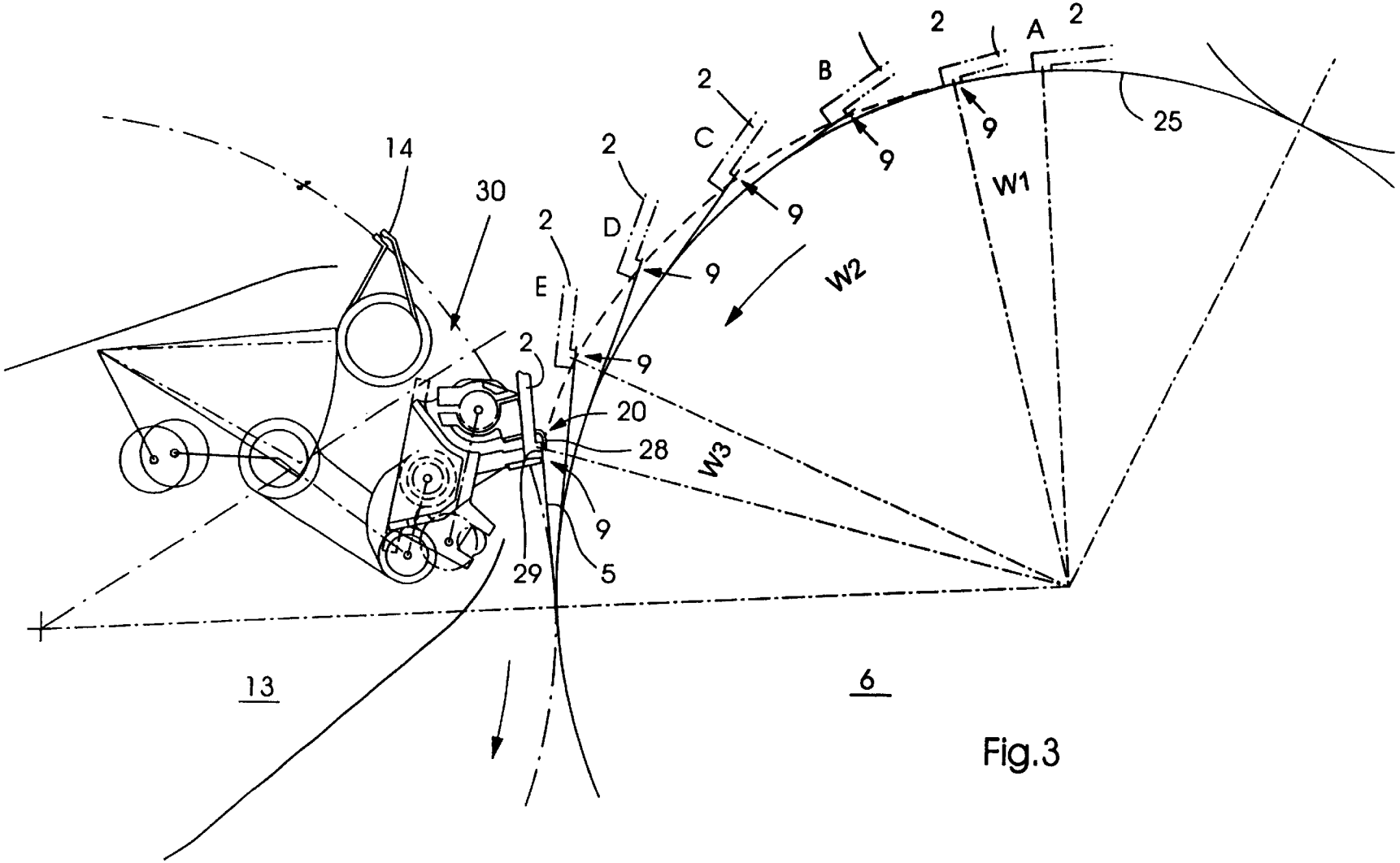
FIG. 3 schematically shows various rotational positions of a sheet while it is being transferred from the first cylinder to the second cylinder by a holding element.

FIG. 3 schematically shows a number of positions of the sheet 5 and the holding element 2, which is arranged outside the cylinders, during the transfer of the sheet 5 from the first cylinder 6 to an intermediate gripper 20 that is arranged on the second cylinder 13. The first cylinder 6 is an impression cylinder, which as part of a turner device, simultaneously functions as a storage drum, while the second cylinder 13 fulfills the function of a turner drum. In a first angular range W1, the holding element 2 is placed onto the sheet trailing edge 9, and in one embodiment (FIG. 6) of the holding element 2, the sheet trailing edge 9 is attracted by suction from a suction duct 21. If no suction duct 21 is provided, the holding element 2 is preferably provided, for example, with a specific adhesive layer, as described in Published German Patent Application DE 199 21 271 A1. The holding element 2 can also have any other type of holding means with which a sheet can be held.

In a second angular range W2, which follows the first angular range W1 in the direction of rotation, the sheet 5 is preferably tensioned by means of a lower rotational movement of the holding element 2, rather than by the rotational movement of the sheet 5, and the sheet 5 is lifted off the circumferential wall 25. Then, in a third angular range W3, the sheet trailing edge 9 is moved in the direction of the intermediate gripper 20 and the sheet 5 continues to be held under tension. In a first position A, the holding element 2 begins to lift the sheet trailing edge 9 off the circumferential wall 25. In a second position B, the sheet trailing edge 9 is lifted further and is additionally tensioned. Likewise, the sheet trailing edge is tensioned further in a third C, fourth D and fifth position E, and is moved toward the intermediate gripper 20. When the sheet trailing edge 9 is picked up, the intermediate gripper 20 engages over the sheet trailing edge 9 and presses the sheet trailing edge 9 against an associated support face by using an angled holding arm 28 so that the sheet trailing edge 9 is firmly fixed on the intermediate gripper 20. After the sheet trailing edge 9 has been clamped firmly, the suction function of the holding element 2 is switched off and the holding element 2 is moved in the direction of a recess 30 in the second cylinder 13. A tongs-type gripper 14 is arranged on the second cylinder 13. The tongs-type gripper 14 is shown in a rest position, and in the direction of rotation of the second cylinder 13, is arranged in the recess 30 downstream of the intermediate gripper 20. From FIG. 3 it can clearly be seen that, as a result of displacing the guidance of the holding element 2 out of the second and first cylinders, more time is available to tension and to transfer the sheet 5.

In addition, it can be seen that the turner drum 13 can be constructed as a flattened transfer drum. As a result, sheet transport is possible in which the printed side of the sheet does not touch the drum.

Figure 4:
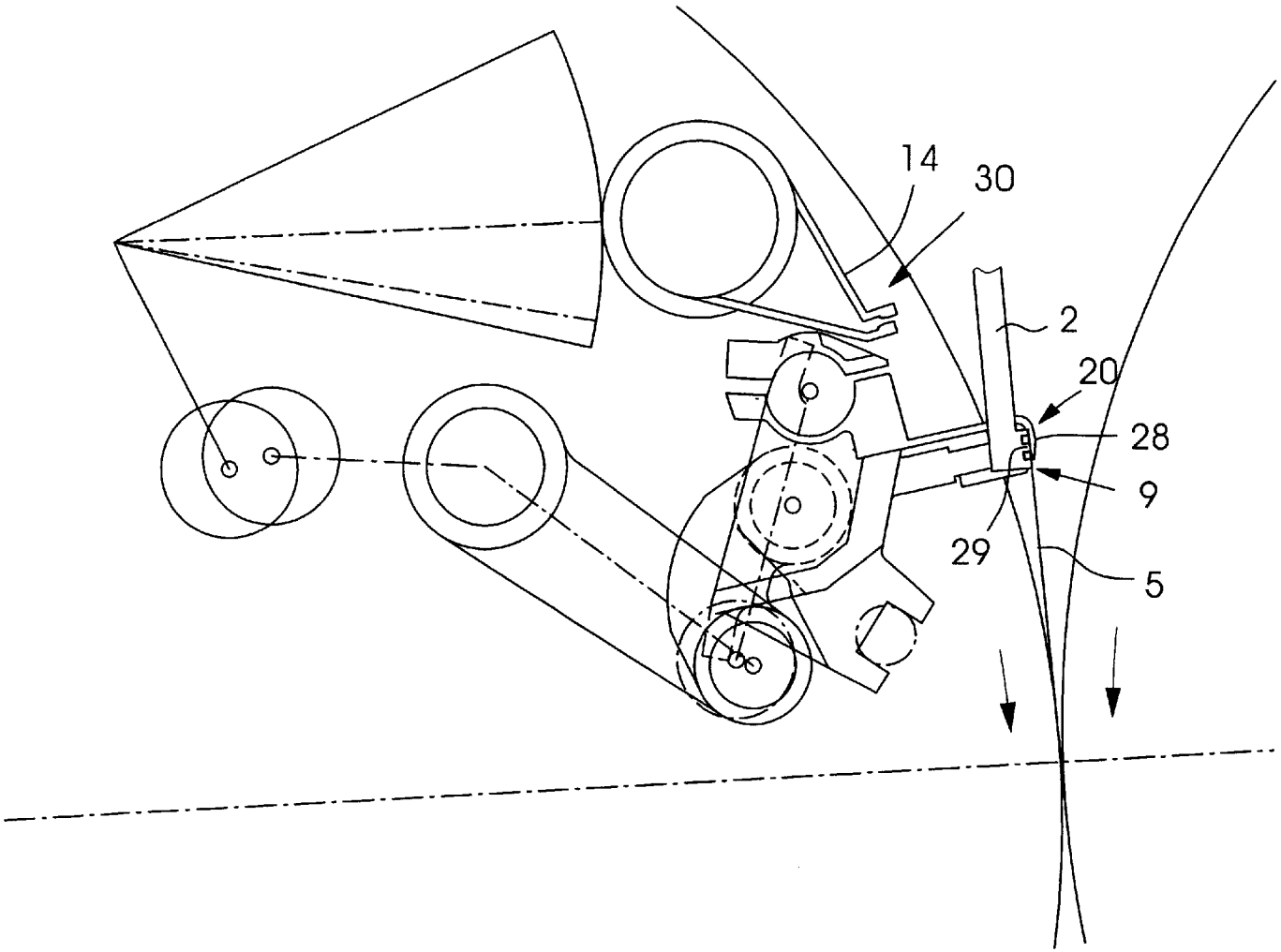
FIG. 4 shows the sheet being transferred from the holding element to an intermediate gripper.

FIG. 4 shows the transfer of the sheet trailing edge 9 from the holding element 2 to the intermediate gripper 20. In a preferred design, the sheet leading edge is released after the intermediate gripper has been closed. In this position, the tongs-type gripper 14 is pivoted into an accommodation area in the second cylinder 13.

Figure 5:
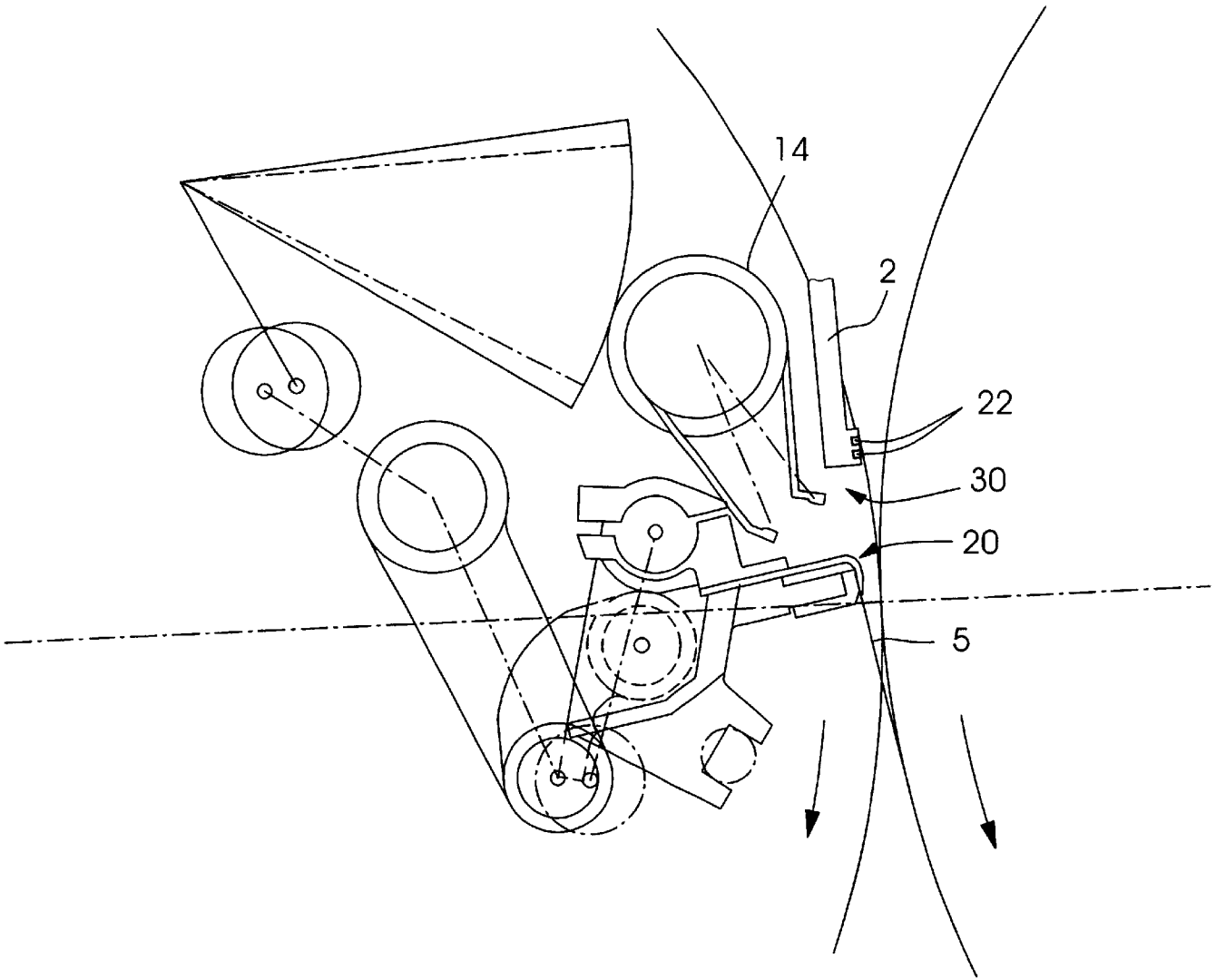
FIG. 5 shows the holding element being pivoted out of the circumferential area of the second cylinder.

In a second method step, which is illustrated in FIG. 5, the holding element 2 is moved past the intermediate gripper 20, out of the recess 30 in the second cylinder 13, and over the tongs-type gripper 14. At the same time, the tongs-type gripper 14 is opened and moved in the direction of the intermediate gripper 20.

Figure 6:
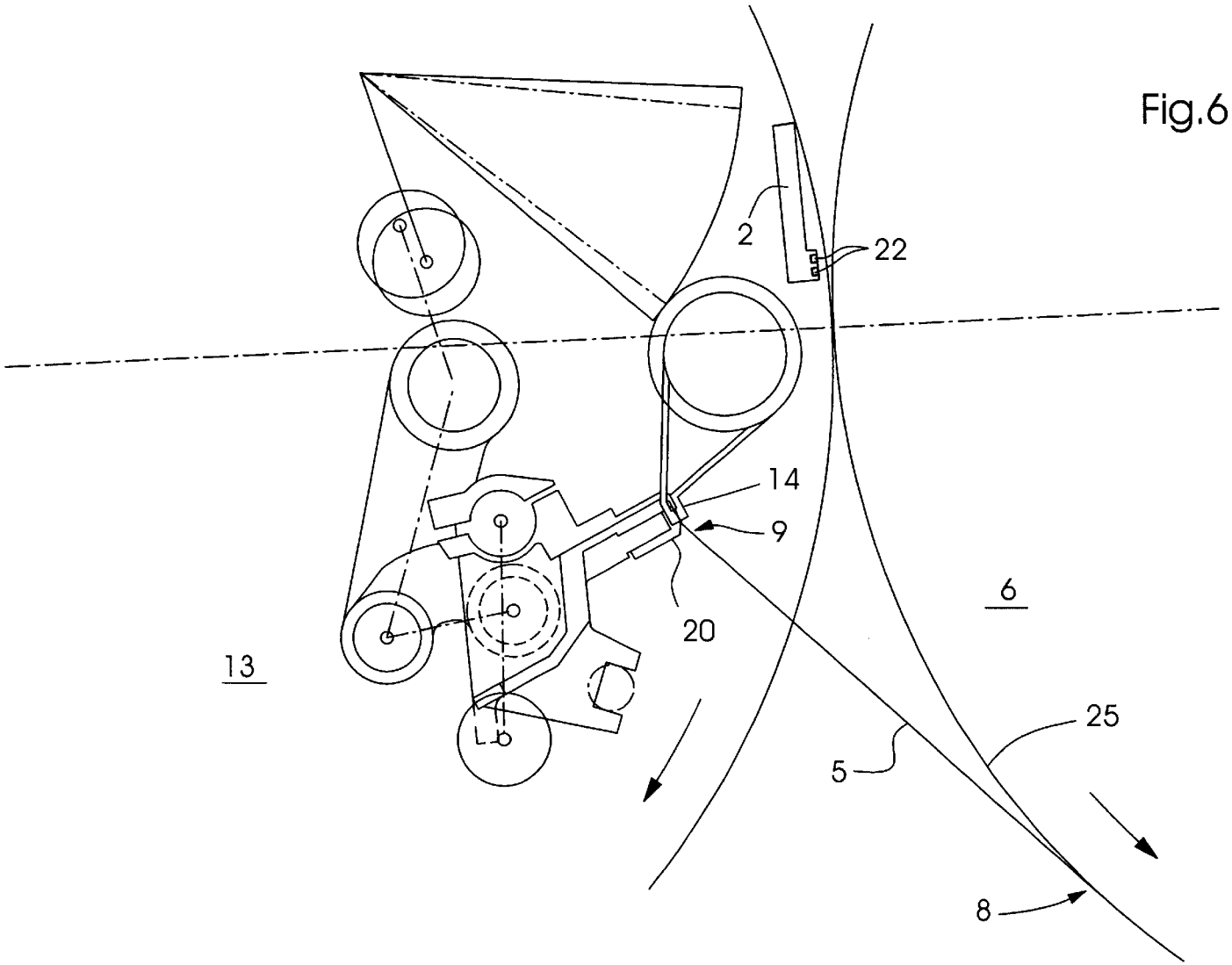
FIG. 6 shows the transfer of the sheet trailing edge to a tongs-type gripper.

FIG. 6 shows the acceptance position between the intermediate gripper 20 and the tongs-type gripper 14. The tongs-type gripper 14 is shown as having just gripped the sheet trailing edge 9 and the intermediate gripper 20 is releasing the sheet trailing edge 9. In this position, the holding element 2 moves out of the recess. In FIG. 6, the suction openings 22 of the holding element 2 are illustrated schematically. After the sheet trailing edge 9 has been accepted by the tongs-type grippers 14, the sheet 5 is moved onward by the tongs-type gripper 14 in accordance with the illustration of FIG. 1 and is led to a third cylinder 23. On the third cylinder 23, for example, the sheet trailing edge or the sheet leading edge 8, 9 is again accepted by an appropriately constructed fifth gripper 27, and the sheet 5 is moved onward over the third cylinder 23.

Figure 7:
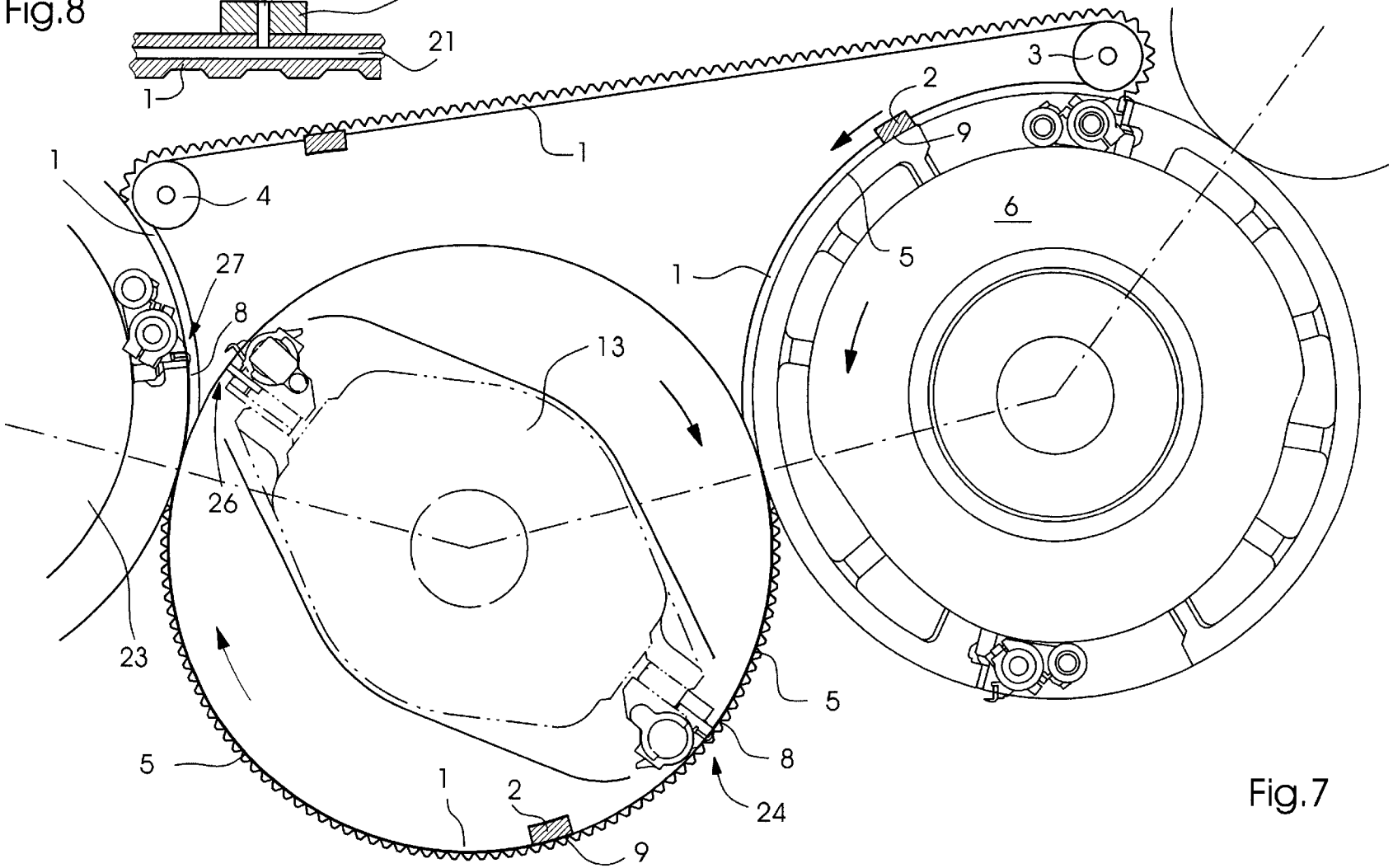
FIG. 7 shows holding elements that are guided around two cylinders.

FIG. 7 shows a development of the invention in which the holding elements 2 are led around a second cylinder 13, in this case a transfer cylinder. This embodiment offers the advantage that the holding element 2 holds a sheet 5 firmly at the sheet trailing edge 9 over a number of cylinders, and therefore guidance of the sheet trailing edge 9 is possible. In this case, however, it is necessary for the holding element 2 to have a device for holding the sheet trailing edge 9 firmly, such as a suction device. In addition, it is advantageous if the second cylinder 13 is constructed in the form of a cylinder that is cut out on two sides, so that there is sufficient space available to arrange the holding element 2, and so that smearing of the transported sheet 5 is ruled out. FIG. 7 shows an appropriately constructed second cylinder 13 having a third and a fourth gripper 24, 26, which are located on opposite sides of the second cylinder 13, and with which a sheet trailing edge or a sheet leading edge can be accepted. In the embodiment shown in FIG. 7, the sheet leading edge 8 of a sheet 5 is accepted by the third gripper 24 and is subsequently transferred to a fifth gripper 27 of the third cylinder 23.

However, the arrangement of FIG. 7 can also be constructed in such a way that a sheet trailing edge of a sheet 5, which is guided on the first cylinder 6, is transferred to the third gripper 24 of the second cylinder 13, and then the sheet leading edge and/or the sheet trailing edge 8, 9 are transferred to the fifth gripper 27 of the third cylinder 23.

In the embodiment illustrated, the second shaft 4 is arranged between the second and third cylinders 13, 23 and above the second cylinder 23. In this way, advantageous guidance of the belt 1 is achieved.

In the embodiment of FIG. 7, the sheet 5 is held on the side of the sheet 5 which faces away from the first cylinder 6, faces the second cylinder 13 and faces away from the third cylinder 23. Because of the embodiment of the belt 1, a guide plate is no longer necessary, for example for the controlled guidance of the sheet 5 in the area of the second cylinder 13, since the sheet 5 is guided on its movement path by the holding element 2.

Figure 8:
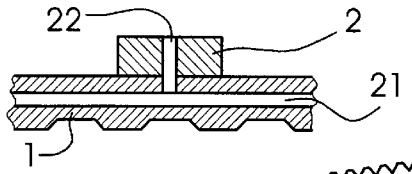
FIG. 8 shows a cross section through a flexible drive.

FIG. 8 shows a cross section through a belt 1 and a holding element 2. The belt 1 is constructed in the form of a toothed belt which has a suction duct 21 that is connected to a suction opening 22 in the holding element 2. The suction duct 21 is connected to an appropriate vacuum pump so that a vacuum can be provided in the suction duct 21 in the belt 1. Using the vacuum, via appropriate suction openings 22 belonging to the holding elements 2, sheets 5 can be attracted by suction. However, the holding element 2 can also be constructed as a gripper or in the form of other holding means, and is not restricted to the design as a suction element.

Figure 9:
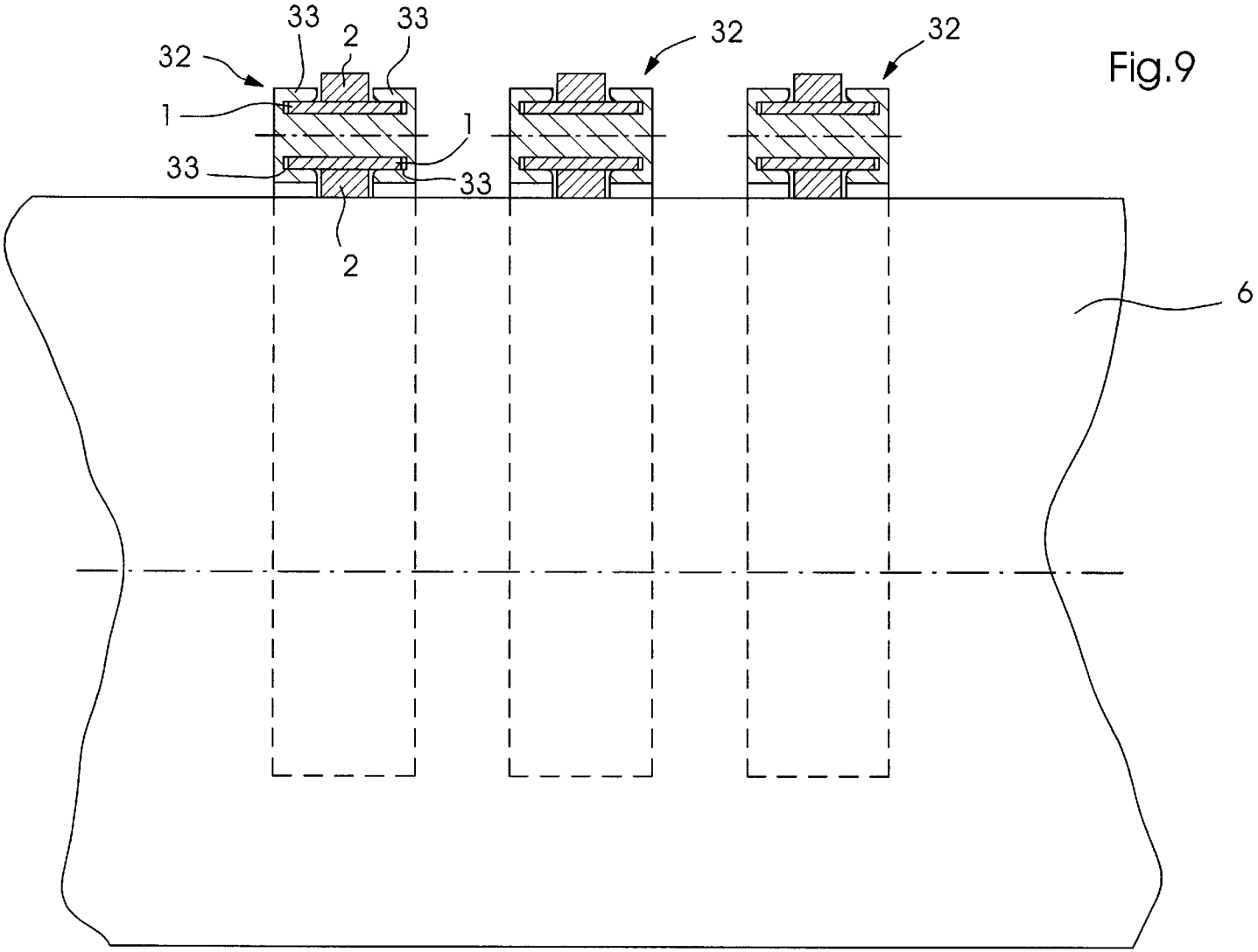
FIG. 9 shows a guide device for a belt.

FIG. 9 schematically shows a cross section through a guide device 32, in which the belt 1 is guided in both directions. In the lower region, the belt 1 moves out of the plane of the drawing, and in the upper region the belt 1 moves into the plane of the drawing. At the sides, guide elements 33 engage around the belt 1, which is guided on an outer side as far as a predefined distance from the center of the belt 1. In this way, the belt is guided both in the horizontal and in the vertical direction. A plurality of guide devices 32 and belts 1 are preferably distributed transversely over the first cylinder 6. It is thus possible for the sheet 5 to be gripped and guided uniformly over its width.

Figure 10:
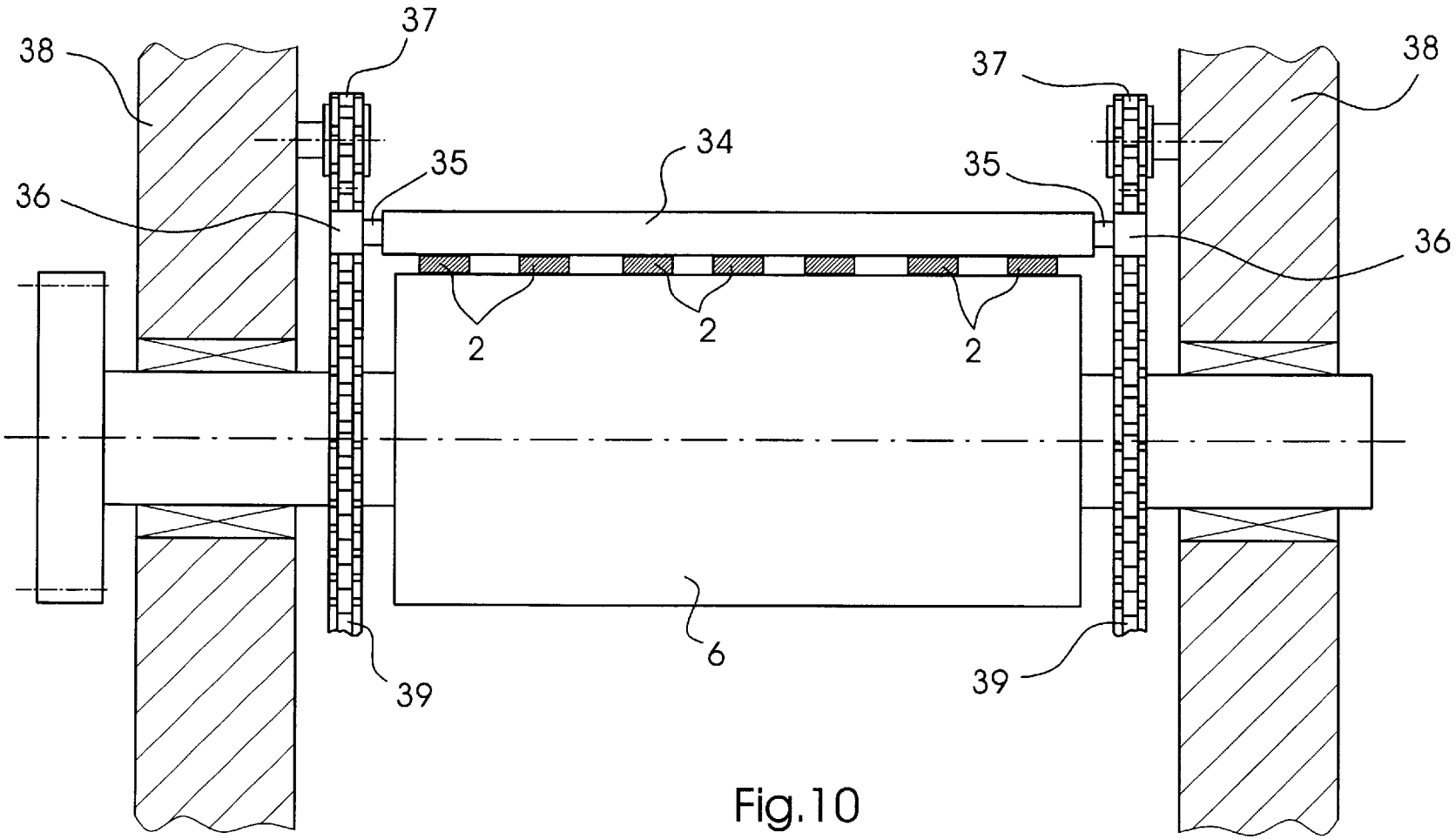
FIG. 10 shows a holding element having lateral chain guides.

FIG. 10 shows a development of the invention in which holding elements 2 are fixed to a bridge element 34. In a simple embodiment, the bridge element 34 is constructed as a hollow tube, and the holding elements 2 are supplied with a vacuum via the recess in the hollow tube so that the holding elements 2 can attract a sheet 5 by suction. To this end, the bridge element 34 is connected to a vacuum pump. At opposite ends, the bridge element 34 has two guide pins 35, which are led to a guide bearing 36. The guide bearings 36 are guided in guide rails 37, which are in turn fixed to side walls 38 of the printing machine. In addition, the first cylinder 6 illustrated is in each case held laterally via a mounting on the side walls 38. The guide bearings 36 are connected to flexible drives, such as chains 39, which move the guide bearings 36 along the guide rail 37.

Figure 11:
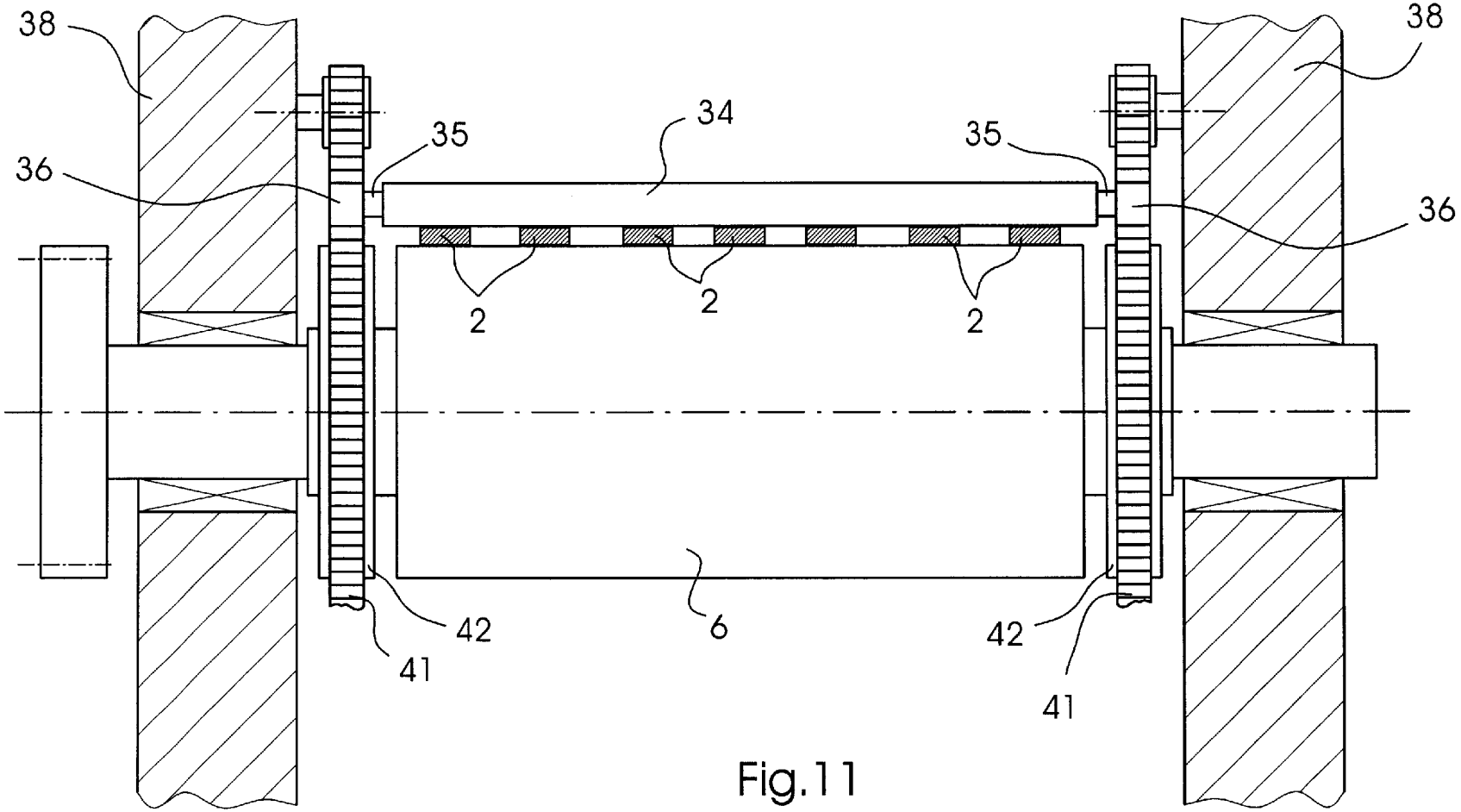
FIG. 11 shows a holding element having drive belts and lateral belt pulleys.

In the embodiment shown in FIG. 11, the flexible drives are constructed as toothed belts 41, which interact with belt pulleys 42 that are driven by the sheet-carrying cylinder. The guide rails 37 are arranged symmetrically in relation to each other and run along the line along which the bridge element 34 is to be guided. This line corresponds, for example, to the line through which the belt 1 in FIG. 1 passes, or the line through which the belt 1 in FIG. 7 passes. In this way, it is possible for the holding elements to be led through between a plurality of cylinders 6, 13, 23. The bridge element 34 is thus arranged between two cylinders only when the holding elements 2 are just transferring or picking up a sheet trailing edge or sheet leading edge. Following the transference or the acceptance of the sheet, the bridge element 34 with the holding elements 2 is moved out of the area between the cylinders 6, 13, 23 again.

Figure 12:
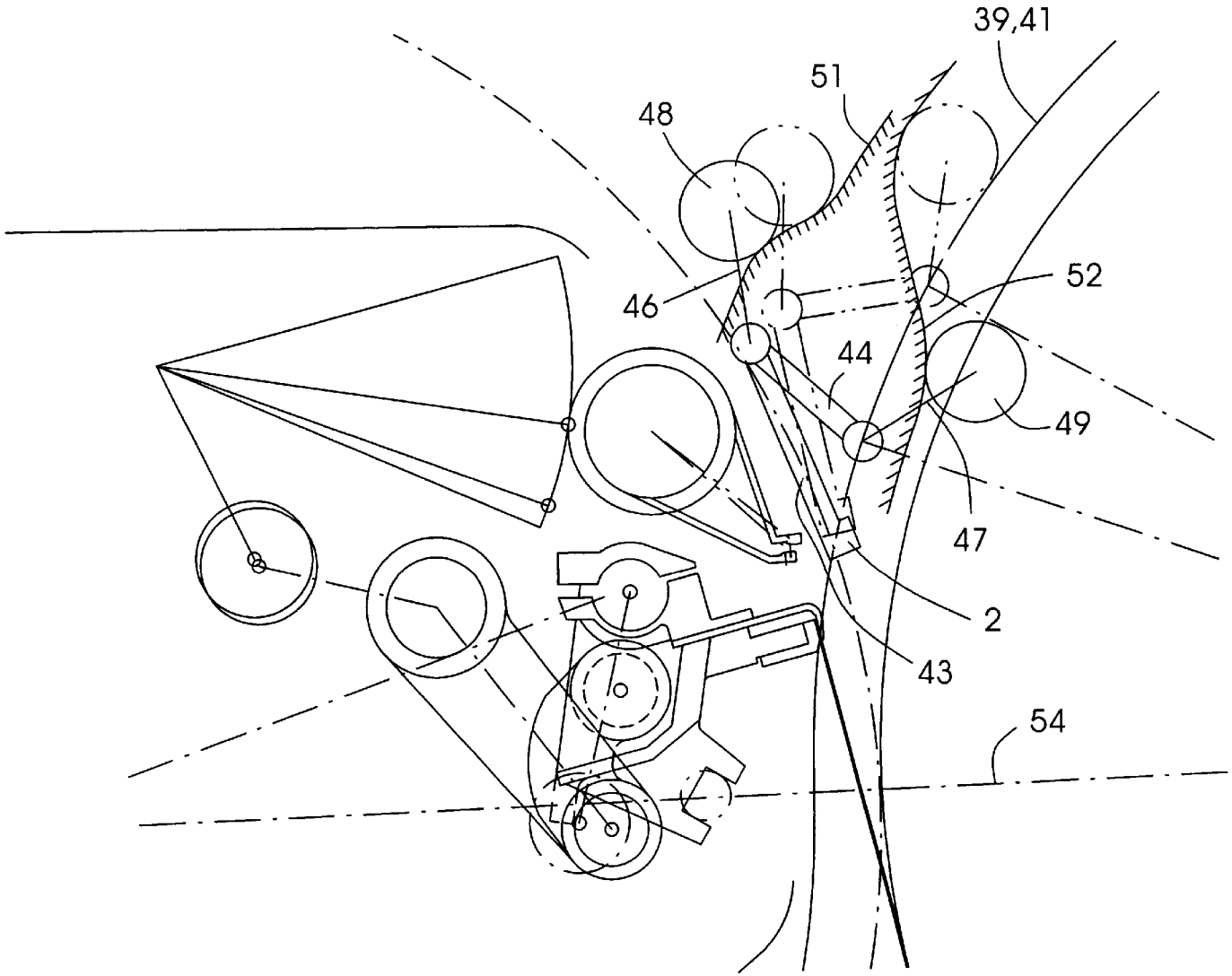
FIG. 12 shows an embodiment of the holding element having two-elements.

FIG. 12 shows an embodiment in which the holding element 2 can be moved by means of two elements 43, 44 that are coupled to each other in an articulated manner. Each element 43; 44 has a roller lever 46; 47 having a control roller 48; 49, each of which comes into contact with a control cam 51; 52 in order to guide the holding element 2 on a movement path which is different from the guide rail 37. In this way, the sheet can be lifted off the upstream cylinder and transferred to the gripper device 20 of the following cylinder. It is also possible, when the multi-element apparatus is used in a turner device, to tension the sheet trailing edge. The apparatus having two elements 43, 44 can therefore be delayed with respect to the transport belt 39, 41, so that the apparatus, folded together, dips into the periphery of the following cylinder after the gripper device, in order in this way to avoid any collision with the gripper device 20 of the following cylinder.

Figure 13:
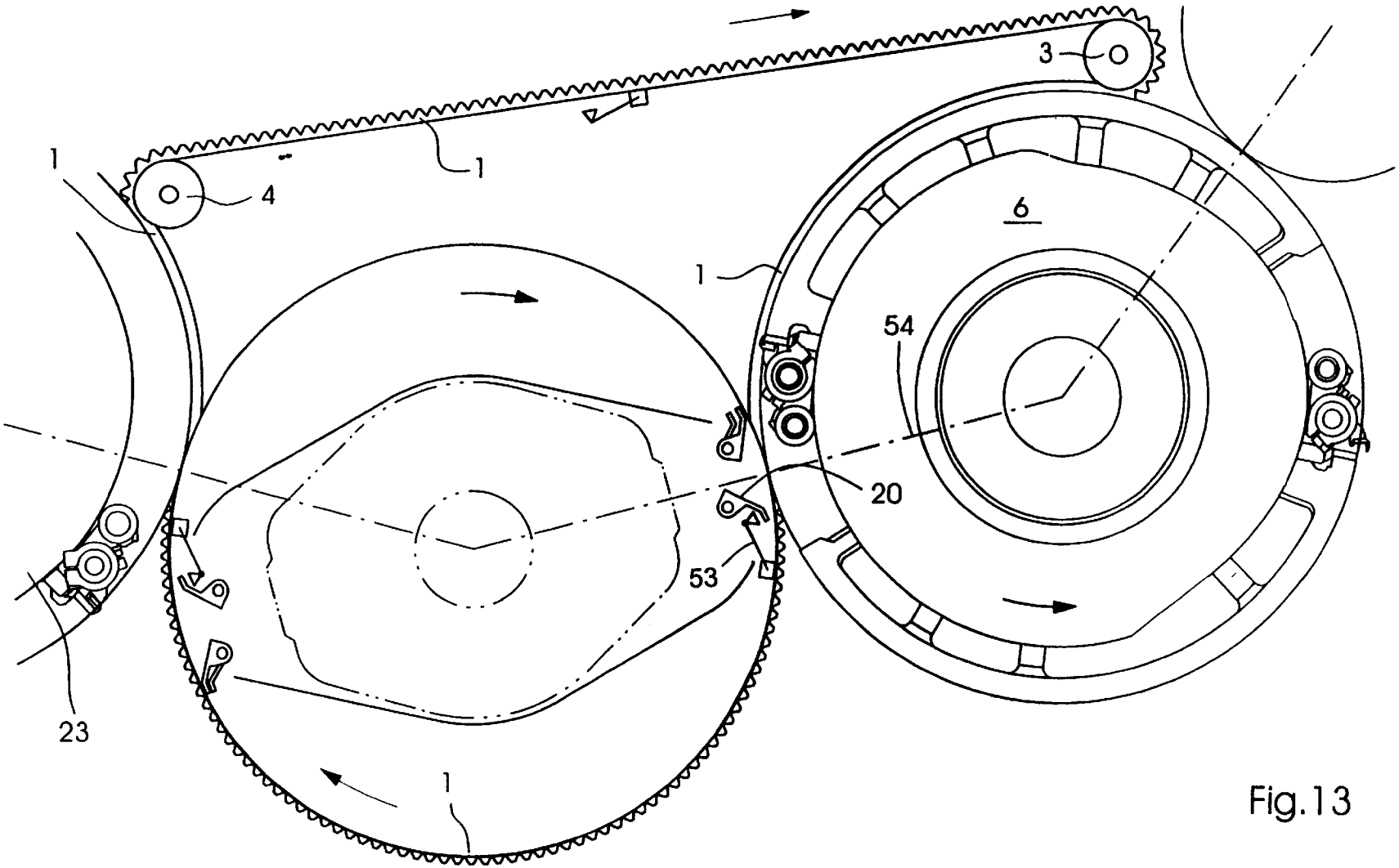
FIG. 13 shows a single-element embodiment of the holding element.

FIG. 13 schematically shows how the holding element 2, which is arranged at the end of a coupler 53 mounted in an articulated manner, is used. As opposed to the multi-element system, the single-element holding system is guided through the transfer center line between the upstream and downstream cylinders before the gripper device 20 passes the transfer center line 54.

Figure 14:
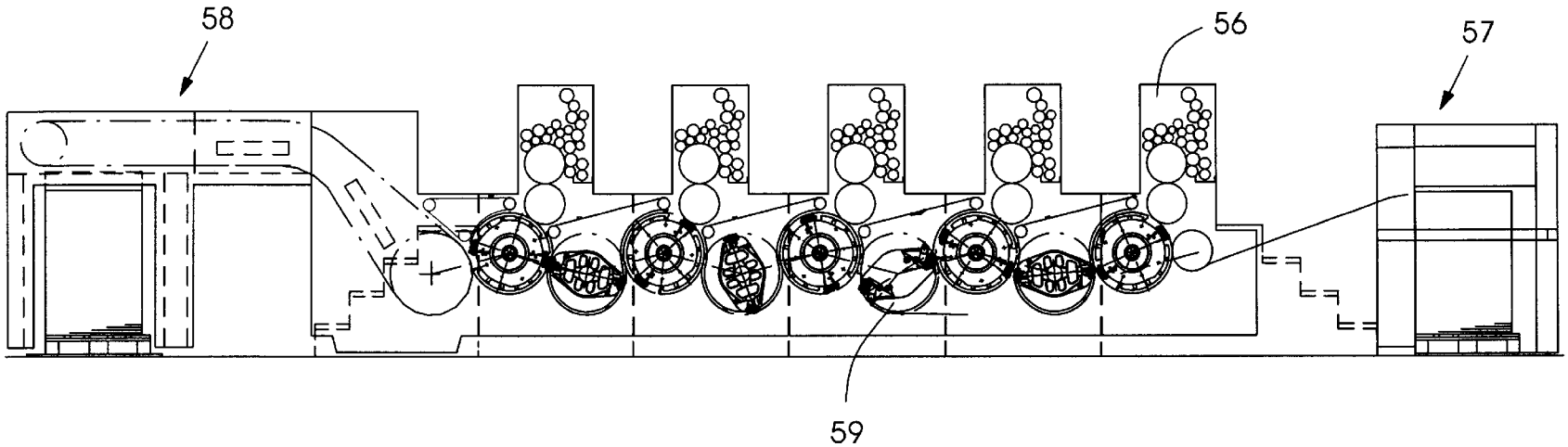
FIG. 14 shows a printing machine having the apparatus for guiding and transferring a sheet in which the apparatus is arranged parallel to the sheet-carrying cylinders.

FIG. 14 shows a printing machine having printing and varnishing units 56, which are arranged between a feeder 57 and a deliverer 58, and which has a turner device 59. The apparatus 1, 2 according to the invention is in this case provided many times and is arranged parallel to the sheet-carrying cylinders, so that a sheet can be held simultaneously at its leading and trailing edge 8, 9 as it is transported through a printing machine.

The invention has been described by using an exemplary embodiment in which the sheet is transferred from one suction gripper to another gripper, but the invention can be used in the case of any type of guidance and transfer of a sheet in a printing machine. The advantages are achieved irrespective of the form of the gripper.

We claim:

1. An apparatus for guiding and transferring a sheet in a sheet-processing machine from a first cylinder to an immediately adjacent second cylinder, the apparatus comprising:

a holding element guiding and transferring the sheet from the first cylinder to the immediately adjacent second cylinder, said holding element retaining one edge of the sheet;

an endless guide device for guiding said holding element, said guide device being held outside the first cylinder and outside the second cylinder; and a gripper disposed on the first cylinder for retaining another edge of the sheet while transferring the sheet from the first cylinder to the immediately adjacent second cylinder.

2. The apparatus according to claim 1, comprising:

a motor; and two end points;

said guide device including at least one belt formed as an endless belt circulating between said two end points;

said motor for driving said belt;

said holding element being fixed to said belt;

the sheet being moved along a movement path; and said belt running at least partially along the movement path of the sheet.

3. The apparatus according to claim 2, wherein:

the second cylinder is formed with a recess; and said holding element is guided and pivoted into and out of the recess in the second cylinder.

4. The apparatus according to claim 2, wherein said at least one belt includes a plurality of belts with holding elements.

5. The apparatus according to claim 4, wherein:

the first cylinder rotates in a direction of rotation; and said plurality of said belts are disposed at different angles with respect to the direction of rotation of the first cylinder.

6. The apparatus according to claim 2, comprising:

at least one other holding element fixed to said belt;

said holding element and said other holding element being associated with sheets that follow one another.

7. The apparatus according to claim 2, wherein:

the sheet is moved along the movement path at a speed; and said motor drives said belt at a running speed that approximately corresponds to the speed of the sheet.

8. The apparatus according to claim 2, wherein said motor has an adjustable drive speed for moving said belt at different speeds.

9. The apparatus according to claim 2, comprising:

a bridge element having opposite sides;

guides guiding said bridge element on said sides; and a flexible drive for moving said bridge element;

said holding element being fixed to said bridge element.

10. The apparatus according to claim 1, comprising:

a bridge element having opposite sides;

guides guiding said bridge element on said sides; and a flexible drive for moving said bridge element;

said holding element being fixed to said bridge element.

11. The apparatus according to claim 1, wherein:

the second cylinder is formed with a recess; and said holding element is guided and pivoted into and out of the recess in the second cylinder.

12. The apparatus according to claim 11, comprising:

a bridge element having opposite sides;

guides guiding said bridge element on said sides; and a flexible drive for moving said bridge element;

said holding element being fixed to said bridge element.

13. The apparatus according to claim 1, comprising:

a bridge element having opposite sides;

guides guiding said bridge element on said sides; and a flexible drive for moving said bridge element;

said holding element being fixed to said bridge element; and said flexible drive being selected from the group consisting of a chain and a toothed belt.

14. The apparatus according to claim 1, wherein said holding element is moved at a lower speed than the sheet, so that the sheet is tensioned.

15. The apparatus according to claim 1, wherein:

the second cylinder has a gripper;

the first cylinder has a further gripper;

said holding element is assigned to a trailing edge of the sheet;

said holding element transfers the trailing edge of the sheet to the gripper;

the further gripper holds a leading edge of the sheet; and after the trailing edge of the sheet has been gripped in register by the gripper, the leading edge of the sheet is released by the further gripper.

16. The apparatus according to claim 1, wherein said holding element holds the sheet in tension.

17. The apparatus according to claim 1, wherein said holding element is assigned to a leading edge of the sheet.

18. The apparatus according to claim 1, wherein said holding element has at least one movable element.

19. The apparatus according to claim 18, comprising at least one control cam for controlling said movable element and at least one control roller for controlling said movable element.

20. The apparatus according to claim 19, comprising a roller lever assigned to said movable element.

21. The apparatus according to claim 20, wherein said holding element is formed as a suction gripper.

22. An apparatus for guiding and transferring a sheet in a sheet-processing machine from a first cylinder to an immediately adjacent second cylinder along a sheet movement path, the apparatus comprising:

a holding element guiding and transferring the sheet from the first cylinder to the immediately adjacent second cylinder;

a guide device for guiding said holding element, said guide device being held outside the first cylinder and outside the second cylinder;

two end points, said guide device including a belt formed as an endless belt circulating between said two end points, said holding element being fixed to said belt, said belt running at least partially along a movement path of the sheet; and a motor for driving said belt;

said holding element being guided between the first cylinder and the second cylinder and around the second cylinder.

23. The apparatus according to claim 22, comprising:

a bridge element having opposite sides;

guides guiding said bridge element on said sides; and a flexible drive for moving said bridge element;

said holding element being fixed to said bridge element.

24. A method of transporting a sheet in a sheet-processing machine from a first cylinder to an immediately adjacent second cylinder, which comprises:

holding one edge of the sheet by a holding element guiding and transferring the sheet from the first cylinder to the immediately adjacent second cylinder; and holding another edge of the sheet while transporting the sheet by a gripper disposed on the first cylinder.

* * * * *